US005197402A

United States Patent [19]

Hunts

[11] Patent Number: 5,197,402

[45] Date of Patent: Mar. 30, 1993

[54] SAILBOARD HARNESS SECURING ASSEMBLY

[76] Inventor: Rick E. Hunts, 8525 Camino Santa Fe, San Diego, Calif. 92121

[21] Appl. No.: 719,415

[22] Filed: Jun. 24, 1991

[51] Int. Cl.[5] ..... B63B 35/00

[52] U.S. Cl. ..... 114/39.2; 114/89

[58] Field of Search ..... 24/197, 200, 68 CD; 114/39.2, 270, 89, 90, 97, 98

[56] References Cited

U.S. PATENT DOCUMENTS 2,893,394 7/1959 Thomsen ..... 24/200

3,067,475 12/1962 Molla ..... 24/200

4,763,591 8/1988 Taylor ..... 114/39.2

*Primary Examiner*—Edwin L. Swinehart

*Attorney, Agent, or Firm*—Henri J. A. Charmasson

[57] ABSTRACT

A sailboard harness boom rope has a length of webbing at each extremity which is secured around the boom by a cinching buckle having arcuate side-members with radius commensurate with the outside radius of the boom and at least three cross-members. One end of the length of webbing forms a closed loop engaging a first of said cross-members, then wraps around the boom and is passed back-and-forth between the cross-members in a quickly releasable cinching arrangement.

7 Claims, 1 Drawing Sheet

SAILBOARD HARNESS SECURING ASSEMBLY

BACKGROUND OF THE INVENTION

This invention relates to cinching buckles for belts and other web-like fasteners, and more particularly to buckles used with the strapping harnesses of sailboards and other sporting equipment.

FIELD OF THE INVENTION

The so-called "Hawaii Trapeze Harness" is used by windsurfers to hook their bodies to the wishbone booms of their crafts for an easier, and even hand-free ride. The sailboard enthusiast wears a chest-high harness with a hook facing downward in the middle of it. On each side of the booms, a cord about 1 meter long is tied to two lengths of webbing which are in turn secured around the boom—one fore, one half—so that the cord lies parallel to the boom in the zone which is usually closest to the sailboard rider's chest. When going upwind, the rider hooks himself to the boom by lifting the boom and engaging the cord under the hook, then laying back to keep the cord tightly stretched along the boom. In this position, the cord must be stretched as tightly as possible along the boom by keeping its opposite webbing attachments as far as possible. When going downwind, the two ends of the rope are tied closer together around the boom in order to allow the rider to lay back farther away from the boom.

Since the cord must be adjusted quickly from the tight to the loose position, various types of buckles and cinching devices have been proposed, but none combine the advantage of a firm and secure attachment with the ability of quickly releasing that attachment and repositioning it along the boom.

SUMMARY OF THE INVENTION

The principal and secondary objects of this invention are to provide a convenient device for securely attaching the ends of a rope to the wishbone boom of a sailboard and to allow the sailboard enthusiast to quickly release that attachment and reposition the ends of the cord along the boom.

These and other objects are achieved by means of a length of webbing attached to each end of the cord and to a cinching buckle which essentially consists of two arcuate side-members having a radius of curvature corresponding to the outside radius of the boom. The side-members are bridged by at least three cross-members through which the web is passed back and forth. A fourth cross-member more radially distal from the boom than the other and projecting from the ends of the side-members can be conveniently pushed with the thumb to release the attachment and slide the assembly along the boom.

BRIEF DESCRIPTION OF THE DRAWING

.

DESCRIPTION OF THE PREFERRED EMBODIMENT OF THE INVENTION

Figure 1:
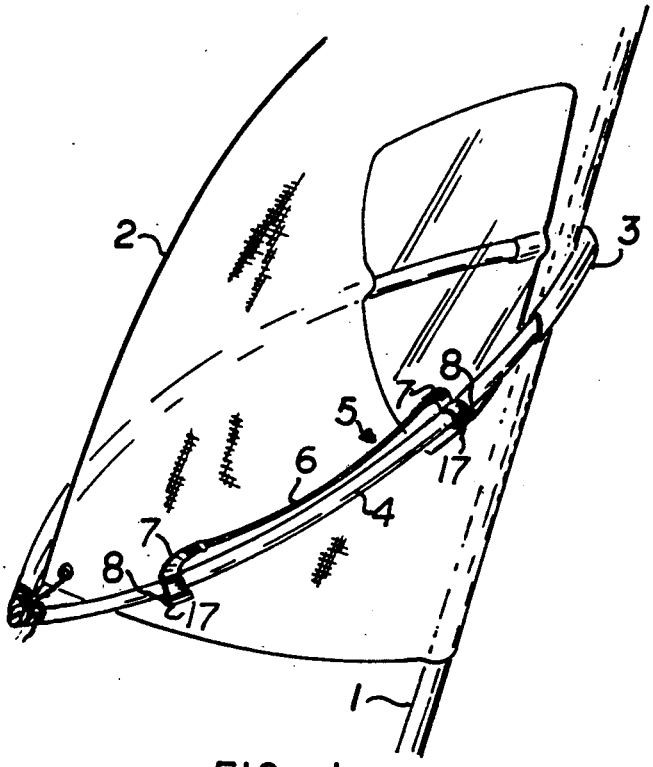
FIG. 1 is a perspective view of the sailboard harness assembly mounted on a sailboard wishbone boom.
Figure 2:
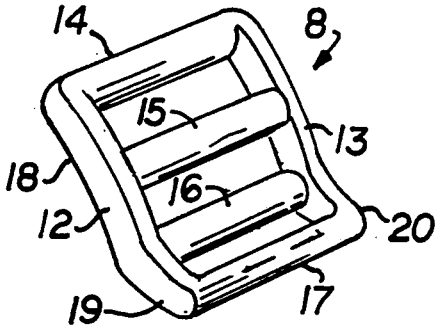
FIG. 2 is a perspective view of the cinching buckle.
Figure 3:
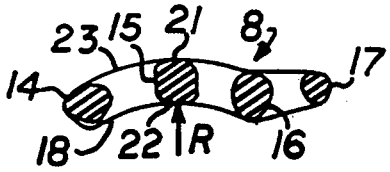
FIG. 3 is a cross-sectional view thereof.

Referring now to the drawing, there are shown in FIG. 1 the mast 1, sail 2 and wishbone boom 3 of a sailboard. The starboard half 4 of the boom is equipped with a cord assembly 5 to be used in connection with a so-called "Hawaii Trapeze Harness". The cord assembly comprises a length of cable or rope 6 having at each extremity a length of webbing 7 secured to the boom by a buckle 8 more specifically illustrated in FIGS. 2 and 3.

Each length of webbing is preferably of a constant thickness and width, and made from a material particularly adapted to a marine environment such as nylon or other synthetic material. In the preferred embodiment of the invention the lengths of webbing have a width of 2.5 centimeters and a thickness of 1.5 millimeters. Each length of webbing 7 is attached at a first extremity 9 to the rope 6. The opposite end 10 is folded back and secured upon itself to form a closed loop 11 as shown in FIG. 4.

The buckle 8 comprises two arcuate and parallel side-members 12, 13 which are joined or bridged by four spaced-apart cross-members 14, 15, 16 and 17. The radius of curvature R of the inner or lower faces 18 of the side-members 12, 13 is commensurate with the radius or curvature of the substantially cylindrical boom section 4 which in most cases is equal to approximately 1.7 centimeters. The first cross-member 14 bridging the first ends of the side-members 12, 13 is engaged through the loop 11 of the length of webbing 7. The second cross-member 15 is spaced-apart from the first cross-member 14, and the third cross-member 16 is spaced-apart from the second cross-member 15, by a distance of at least twice and no more than four times the thickness of the length of webbing 7. The fourth cross-member 17 radially more distal from the boom than the first, second and third cross-members, has two lateral projections 19, 20 which connect to the other ends of the side members 12, 13 bridged by the third cross-member 16. The distance between the fourth and third cross-members is not particularly critical but is preferably commensurate with the spacing between the other cross-members. The width of the first, second and third cross-members is preferably equal to said spacing and should not exceed five times the thickness of the length of webbing. The second cross-member 15 has a substantially square cross-section with two sides 21, 22 tangent to the upper surface 23 and lower surface 18 of the side-members.

Figure 4:
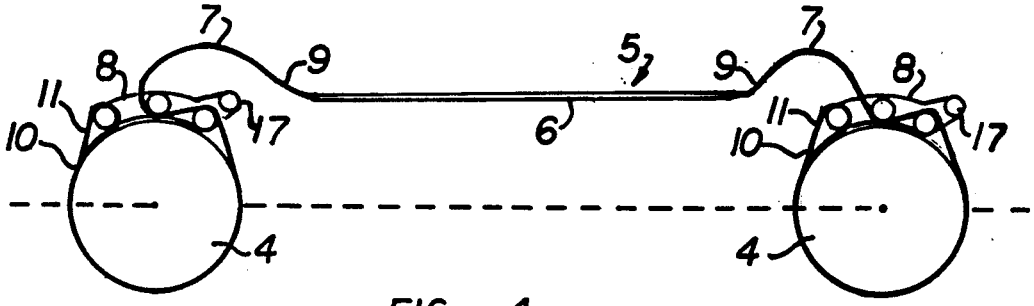
FIG. 4 is a diagrammatical view of the entire harness securing assembly shown upside down on a boom for clarity.

As more specifically illustrated in FIG. 4, each length of webbing, starting from the looped end 10, wraps around the boom 4 then passes between the fourth cross-member 17 and third cross-member 16, then back between the third cross-member and the second cross-member 15, and forth between the second cross-member and first cross-member 14 before attaching to the rope 6. As shown in FIG. 1, the buckles 8 are oriented so that the fourth cross-member 17 points toward the user. As the sailboard rider holds the boom with palms wrapped around it, he or she can use the thumb of each hand to push down against the fourth cross-member 17 to release the pinching pressure applied to the length of webbing between the second cross-member 15 and the underlying section of the boom 4. The buckle and entire attachment can be conveniently slid back-and-forth along the boom for adjusting the position and tightness of the rope 6.

While the preferred embodiment of the invention has been described, modifications can be made and other embodiments may be devised without departing from the spirit of the invention and the scope of the appended claims.

What is claimed is:

1. In combination with a substantially cylindrical boom, a lineyard assembly which comprises:

a length of webbing of constant width and thickness, said length of webbing having a distal end folded back and secured upon itself to form a closed loop;

a cinching buckle comprising:

a pair of parallel side members;

a first cross-member bridging first ends of said side-members, said first cross member being engaged through said closed loop;

a first one of said pair of parallel side-members being arcuate along a substantially portion of tis longitudinal dimension within a first plane;

a second one of said parallel side-members being arcuate along a substantial portion of its longitudinal dimension within a second plane;

said first and second planes being substantially perpendicular to said first cross-member;

a second cross-member spaced apart from, and parallel to, said first cross-member, and bridging said two side-members; and a third cross-member parallel to said first and second cross-members and bridging the opposite ends of said side-members.

2. In combination with a substantially cylindrical boom, a lineyard assembly which comprises:

a length of webbing of constant width and thickness, said length of webbing having a distal end folded back and secured upon itself to form a closed loop;

a cinching buckle comprising:

a pair of arcuate, parallel side members having a radius of curvature substantially equal to the outside radius of the boom;

a first cross-member bridging first ends of said side-members, said first cross member being engaged through said closed loop;

a second cross-member spaced apart from, and parallel to, said first cross-member, and bridging said two side-members; and a third cross-member parallel to said first and second cross-members and bridging the opposite ends of said side-members.

3. The combination of claim 2, wherein each of the spacings between the first and second cross-member and between the second and third cross-member is equal to at least twice, and no more than four time the thickness of the length of webbing.

4. The combination of claim 3, which further comprises a fourth cross-member parallel and spaced-apart from said third cross-member, and having at each opposite extremities a projection extending to one of said opposite ends of one of the side-members, said fourth cross-member being at a longer radial distance from the boom than said first, second and third cross-members.

5. The combination of claim 4, wherein each of said first, second and third cross-members has a cross-diameter equal to no more than five times the thickness of said length of webbing.

6. The combination of claim 5, wherein said second cross-member has a substantially square cross-section and two parallel sides tangent to arcuate faces of said side-members.

7. The combination of claim 4, wherein said boom comprises one-half of a sailboard wishbone boom;

said combination further comprise a second lineyard assembly and a length of cord attached at each opposite end to one of said assemblies; and wherein each of said length of webbing from a point starting at said closed loop, wraps around one boom, passes between said third and fourth cross-members, then back between said second and third cross-members, then forth between said first and second cross-members, and has a distal end attached to said cord.

* * * * *